US011974638B1

(12) United States Patent
Tsai

(10) Patent No.: US 11,974,638 B1
(45) Date of Patent: May 7, 2024

(54) BUCKLE STRAP

(71) Applicant: E-BEST HOLDING COMPANY LIMITED, Hong Kong (CN)

(72) Inventor: Hai Pin Tsai, Hong Kong (CN)

(73) Assignee: E-BEST HOLDING COMPANY LIMITED, Hong Kong (CN)

( * ) Notice: Subject to any disclaimer, the term of this patent is extended or adjusted under 35 U.S.C. 154(b) by 0 days.

(21) Appl. No.: 18/093,327

(22) Filed: Jan. 5, 2023

(51) Int. Cl.
*A44B 11/00* (2006.01)
*A45F 5/00* (2006.01)

(52) U.S. Cl.
CPC ..... *A44B 11/006* (2013.01); *A45F 5/004* (2013.01)

(58) Field of Classification Search
CPC ..... A45F 5/004; A44B 11/006
See application file for complete search history.

(56) References Cited

U.S. PATENT DOCUMENTS

| | | | | |
|---|---|---|---|---|
| 6,823,566 | B2 * | 11/2004 | Coffey | A45C 13/20 24/DIG. 31 |
| 10,130,162 | B2 * | 11/2018 | Tang | A45C 13/30 |
| 10,421,312 | B1 * | 9/2019 | Chang | G01B 3/06 |
| 10,702,049 | B2 * | 7/2020 | Tsai | A44B 11/2592 |
| 2020/0054118 | A1 * | 2/2020 | Tsai | A44B 11/2592 |

* cited by examiner

*Primary Examiner* — Robert Sandy

(57) ABSTRACT

A buckle strap is provided, including a hanging member, a base and a flexible strap. The base is connected to the hanging member, and a fixing hole is defined in the base. A first end of the flexible strap is fixedly connected to the base, and a fixing block is disposed at a second end of the flexible strap. The flexible strap is configured to be bendable and deformable, to allow the fixing block to be close to and stuck in the fixing hole, so as to form a loop for attaching a hanging item. The fixing block is further configured to be pressed, so as to detach from the fixing hole.

10 Claims, 11 Drawing Sheets

BUCKLE STRAP

TECHNICAL FIELD

The present disclosure relates to the technical field of components for hanging, in particular to a buckle strap.

BACKGROUND

Buckle straps are often used to attach personal belongings such as keychains, access cards, etc. In the related art, Chinese patent application No. CN209883204U discloses a buckle strap, including a body and a fastening strap. The fastening strap includes a first main body and a second main body. The second main body is sleeved on the first main body. The second main body includes a support portion, a second moving portion, and a strap body extending along a bottom of the support portion. An end of the second moving portion is fixedly connected to the support portion, and the other end of the second moving portion is movable with respect to the support portion. The second moving portion includes a pair of side walls and a pair of holding walls. The strap body is an elastic and bendable plastic body. The strap body is configured to attach a hanging item. A fixing hole is defined in the strap body. By pressing the side walls, the holding walls are fixed to or detached from the fixing hole, so as to open or close the strap body. This type of buckle strap has a complicated structure, and is inconvenient to use.

SUMMARY

Embodiments of the present disclosure provides a buckle strap, so as to solve the foregoing problems that the buckle straps in the related art have complicated structures and are inconvenient to use.

The present disclosure provides a buckle strap, including:

a hanging member;

a base, the base being connected to the hanging member, and a fixing hole being defined in the base; and a flexible strap, a first end of the flexible strap being fixedly connected to the base, a fixing block being disposed at a second end of the flexible strap, the flexible strap being configured to be bendable and deformable, to allow the fixing block to be close to and stuck in the fixing hole, so as to form a loop for attaching a hanging item, and the fixing block being further configured to be pressed, so as to detach from the fixing hole.

In some embodiments, a mounting hole is defined in the base; the mounting hole is in communication with the fixing hole; the mounting hole has a first hole wall and a second hole wall opposite to each other; an end of the flexible strap away from the fixing block is connected to the first hole wall; the fixing hole is circumferentially closed, and is defined in the second hole wall; and the fixing block protrudes out of a side of the flexible strap facing away from the second hole wall, in a case that the flexible strap is straightened.

In some embodiments, the flexible strap includes two connection portions spaced apart, and a bending portion connected between the two connection portions. A thickness of the connection portions is greater than a thickness of the bending portion. A first one of the two connection portions is connected to the first hole wall, and a second one of the two connection portions is connected to the fixing block. More than two spaced grooves are defined in the bending portion and the connection portions respectively. The more than two grooves are distributed on a side of the connection portions and the bending portion facing away from the fixing block, in a case that the flexible strap is straightened.

In some embodiments, the buckle strap further includes two support bars. The two support bars are connected to the first hole wall and protrude out of the mounting hole, and the two support bars are disposed at intervals from the second hole wall. The two support bars are located between the two connection portions, in a case that the fixing block is stuck in the fixing hole.

In some embodiments, the hanging member includes a hanging band, a first fastener, and a second fastener. The first fastener is connected to a first end of the hanging band, and the second fastener is connected to a second end of the hanging band. The second fastener is configured to be in detachable engagement with the second fastener, so as to form a hanging hole with the hanging band.

In some embodiments, the hanging member includes a clip. The clip is configured to be pressed, so as to form a width-variable opening.

In some embodiments, the hanging member includes a shell, a reset assembly, and a pull cord. The accommodation cavity is defined in the shell. The reset assembly is accommodated in the accommodation cavity. A first end of the pull cord is fixedly connected to the reset assembly, and a second end of the pull cord is fixedly connected to the base. The base is configured to pull the pull cord out of the accommodation cavity. The reset assembly is configured to drive the pull cord been pulled out of the accommodation cavity to retract into the shell and wind around the reset assembly.

In some embodiments, the hanging member further includes a clasp structure. The clasp structure includes a holding portion, and a moving portion movably connected to the holding portion. The holding portion is connected to the shell, an end of the moving portion abuts against the holding portion, and the moving portion is configured to be pressed, so as to allow the moving portion and the holding portion to form a width-variable opening.

In some embodiments, the hanging member includes a lanyard, a first snap-fit portion, and a second snap-fit portion. The lanyard is disposed to pass through an end of the shell away from the base, the first snap-fit portion is connected to a first end of the lanyard, the second snap-fit portion is connected to a second other end of the lanyard, and the first snap-fit portion is configured to be in detachable snap-fit connection with the second snap-fit portion, so as to form a hanging hole with the lanyard.

In some embodiments, the hanging member includes a magnetic attraction component. The magnetic attraction component is disposed at an end of the shell close to the base, and is configured to be in magnetic attraction operation with the base.

The buckle strap provided by the present disclosure has at least the following beneficial effects:

The buckle strap includes a hanging member, a base and a flexible strap. The base is connected to the hanging member, and a fixing hole is defined in the base. A first end of the flexible strap is fixedly connected to the base, and a fixing block is disposed on a second end of the flexible strap. The flexible strap is configured to be bendable and deformable, so as to allow the fixing block to be close to and stuck in the fixing hole, thereby forming a loop for attaching a hanging item. The fixing block is further configured to be pressed, so as to detach from the fixing hole. The buckle strap provided herein has a relatively simple structure. By buckling the fixing block into the fixing hole, the loop can be formed, to attach the hanging item. In addition, the fixing block can be detached from the fixing hole after being pressed, which facilitates the replacement of the hanging item. Thus, the buckle strap provided herein is easy to use.

BRIEF DESCRIPTION OF THE DRAWINGS

In order to more clearly describe the embodiments of the present disclosure or the technical solutions in the relate art, drawings used for description of the embodiments or the related art are briefly introduced below. It will be appreciated that the drawings in the following description are merely some embodiments of the present disclosure. Those skilled in the art may obtain other drawings according to these drawings without any creative thinking.

REFERENCE NUMERALS

Figure 1:
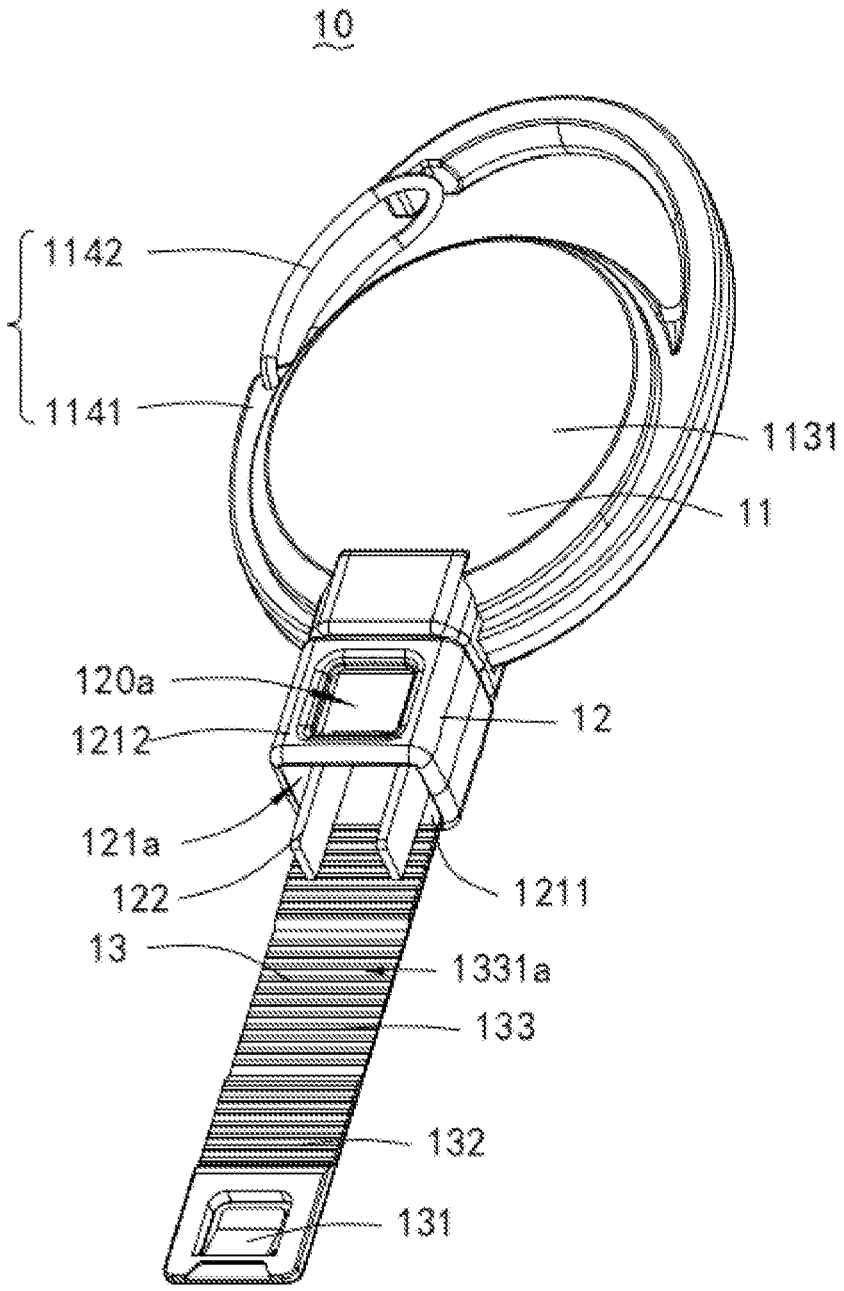
FIG. 1 is a schematic diagram showing that a flexible strap of a buckle strap according to a first embodiment is straightened.

10. buckle strap; 11. hanging member; 1111. hanging band; 1112. first fastener; 1113. second fastener; 1112*a*. notch; 112. clip; 1131. shell; 1131*a*. accommodation cavity; 1132. reset component; 1133. pull cord; 1134. axle wheel; 1135. clockwork; 1136. elastic piece; 1137*a*. rotation hole; 114. clasp structure; 1141. holding portion; 1142. moving portion; 1151. lanyard; 1152. first snap-fit portion; 1153. second snap-fit portion; 1154. connection ring; 1155. lanyard body; 116. magnetic attraction component; 12. base; 120*a*. fixing hole; 121*a*. mounting hole; 1211. first hole wall; 1212. second hole wall; 122. support bar; 13. flexible strap; 131. fixing block; 132. connection portion; 133. bending portion; 1331*a*. groove.

DETAILED DESCRIPTION OF THE EMBODIMENTS

In order to facilitate the understanding of the present disclosure, the present disclosure will be detailed hereinafter with reference to the accompanying drawings. Preferred embodiments of the present disclosure are illustrated in the drawings. However, the present disclosure may be implemented in various forms and is not limited to the embodiments described herein. These embodiments are provided for more thorough and comprehensive understanding of the present disclosure.

It should be noted that when a component is referred to as "fixed" to another component, it may be directly disposed on the other component or there may be an intermediate component. When a component is considered to be "connected" to another component, it may be directly connected to another component or there may be an intermediate component at the same time. The terms "vertical," "horizontal," "left," "right," and etc. used herein are for illustration purpose only.

Unless otherwise defined, all technical and scientific terms used herein have the same meanings as those generally understood by those skilled in the art. The terms used herein in the description of the present disclosure are for the purpose of describing specific embodiments and are not intended to limit the present disclosure. The term "and/or" as used herein includes any and all combinations of one or more related listed items.

Figure 2:
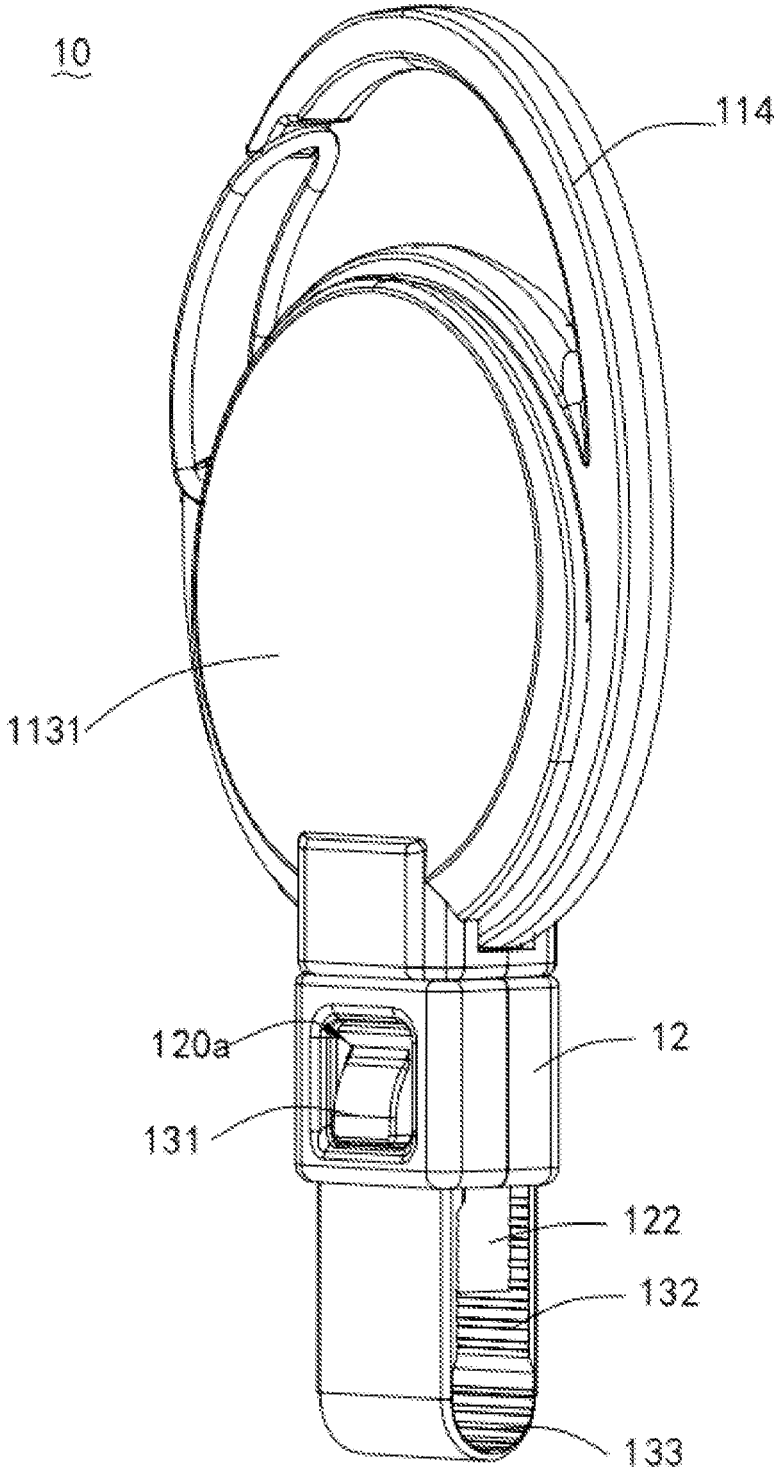
FIG. 2 is a schematic diagram showing that a fixing block of a buckle strap according to a first embodiment is stuck into a fixing hole.

Referring to FIG. 1 and FIG. 2, the present disclosure provides a buckle strap 10, including a hanging member 11, a base 12, and a flexible strap 13. The base 12 is connected to the hanging member 11, and a fixing hole 120*a* is defined in the base 12. The base 12 is fixedly connected to a first end of the flexible strap 13, and a fixing block 131 is disposed on a second end of the flexible strap 13. The flexible strap 13 is configured to be bendable and deformable, so as to allow the fixing block 131 to be close to and stuck in the fixing hole 120*a*, thereby forming a loop for attaching a hanging item. The fixing block 131 is further configured to detach from the fixing hole 120*a* after being pressed. This buckle strap 10 has a relatively simple structure. The loop for attaching the hanging item can be formed only by buckling the fixing block 131 into the fixing hole 120*a*. In addition, the fixing block 131 can be detached from the fixing hole 120*a* after being pressed, which facilitates the replacement of the hanging item. Thus, this buckle strap 10 is also easy to use.

Specifically, in some embodiments, a mounting hole 121*a* is defined in the base 12. The mounting hole 121*a* is circumferentially closed. The mounting hole 121*a* is in communication with the fixing hole 120*a*. The mounting hole 121*a* has a first hole wall 1211 and a second hole wall 1212 that are opposite to each other. An end of the flexible strap 13 away from the fixing block 131 is connected to the first hole wall 1211. The fixing hole 120*a* is circumferentially closed, and is defined in the second hole wall 1212. When the flexible strap 13 is straightened, the fixing block 131 protrudes out of a side of the flexible strap 13 facing away from the second hole wall 1212. When the flexible strap 13 is close to and stuck in the fixing hole 120*a*, the fixing block 131 protrudes out of the fixing hole 120*a*.

In some embodiments, the flexible strap 13 may be an elastic and bendable plastic body. The flexible strap 13 may include two connection portions 132 spaced apart, and a bending portion 133 connected between the two connection portions 132. A thickness of the connection portions 132 is greater than a thickness of the bending portion 133. A first one of the connection portions 132 is connected to the first hole wall 1211, and a second one of the connection portions 132 is connected to the fixing block 131. At least two grooves 1331*a* spaced apart are defined in the bending portion 133 and the connection portions 132 respectively. When the flexible strap 13 is straightened, the grooves 1331*a* are distributed on a side of the connection portions 132 and the bending portion 133 facing away from the fixing block 131. The bending portion 133 has a smaller thickness than the connection portions 132, and are provided with more than two grooves 1331*a* spaced apart, which makes it easier for the flexible strap 13 to bend and deform. The flexible strap 13 is easier to bend and not easy to break, thereby improving a service life of the flexible strap 13.

In some embodiments, the buckle strap 10 further includes two support bars 122. The two support bars 122 are connected to the first hole wall 1211 and extend out of the mounting hole 121*a*. Also, the two support bars 122 are disposed at intervals and oppositely. The support bars 122 are disposed at intervals from the second hole wall 1212. When the fixing block 131 is stuck in the fixing hole 120*a*, the support bars 122 are located between the two connection portions 132. The support bars 122 help to increase the rigidity of the connection portions 132, so that the loop formed when the fixing block 131 is stuck in the fixing hole 120*a* has a certain width; and in addition, the support bars 122 provide a support function.

Figure 3:
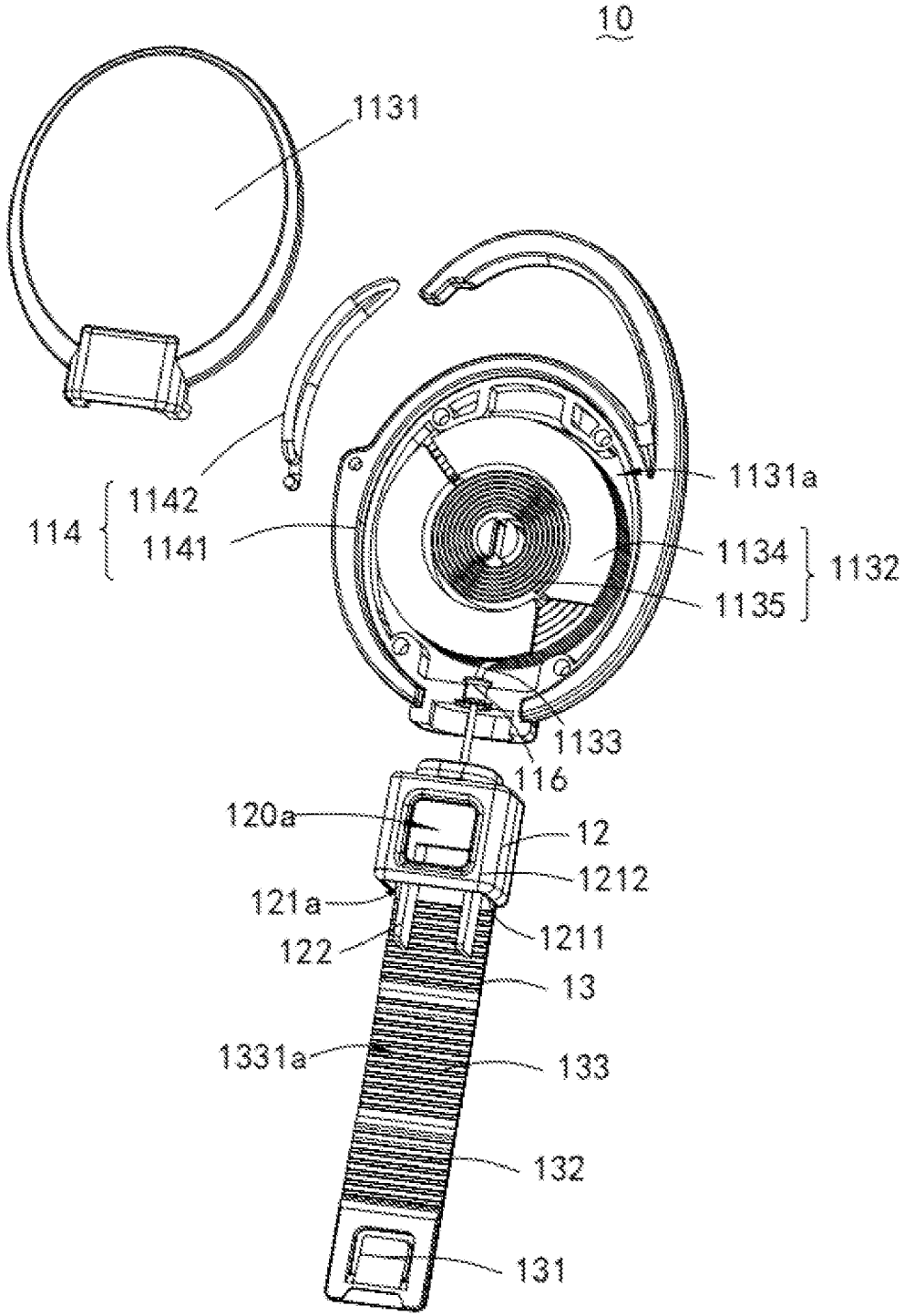
FIG. 3 is an exploded diagram of a buckle strap according to a first embodiment.

Referring to FIG. 1 and FIG. 3, in some embodiments, the hanging member 11 may include a shell 1131, a reset assembly 1132, and a pull cord 1133. A cross-section of the shell 1131 may be a combination of circular and rectangular shapes. An accommodation cavity 1131*a* is defined in the shell 1131, and the reset assembly is 1132 accommodated in the accommodation cavity 1131*a*. The pull cord 1133 may be a nylon cord or other flexible and bendable cord body. A first end of the pull cord 1133 is fixedly connected to the reset assembly 1132, and a second end of the pull cord 1333 is fixedly connected to the base 12. The base 12 is configured to pull the pull cord 1133 out of the accommodation cavity 1131*a*. The reset assembly 1132 is configured to drive the pull cord 1133 been pulled out of the accommodation cavity 1131*a* to retract into the shell 1131 and wind around the reset assembly 1132. Specifically, the reset assembly 1132 includes an axle wheel 1134 and a clockwork 1135 connected to the axle wheel 1134. A first end of the pull cord 1133 is fixedly connected to the axle wheel 1134, and a second end of the pull cord 1133 is fixedly connected to the base 12. After the pull cord 1133 is pulled out of the accommodation cavity 1131*a*, the clockwork 1135 generates a restoring elastic force, which drives the pull cord 1133 to retract into the shell 1131 and wind around the axle wheel 1134 again.

The hanging member 11 may include a magnetic attraction component 116. The magnetic attraction component 116 is disposed at an end of the shell 1131 close to the base 12, and is configured to be in magnetic attraction cooperation with the base 12. The magnetic attraction component 116 may be a magnet or other magnetic component. An end of the base 12 close to the hanging member 11 may be made of a magnetic metal material such as iron, cobalt, nickel and alloys thereof. In the related art, the hanging member 11 is in snap-fit connection with the base 12. When pulling the pull cord 1133 out of the accommodation cavity 1131*a*, a pressing action needs to be applied to a button, so as to detach the base 12 from the hanging member 11, which is inconvenient to use. According to the buckle strap 10 provided by the present disclosure, the base 12 is in the magnetic attraction cooperation with the hanging member 11. In this way, the pull cord 1133 can be pulled out directly, which allows a user to use a hanging item such as a key, an access card, etc. without removing the buckle strap 10. Thus, the buckle strap 10 provided herein has the advantages of simple structure and being easy to use.

Figure 4:
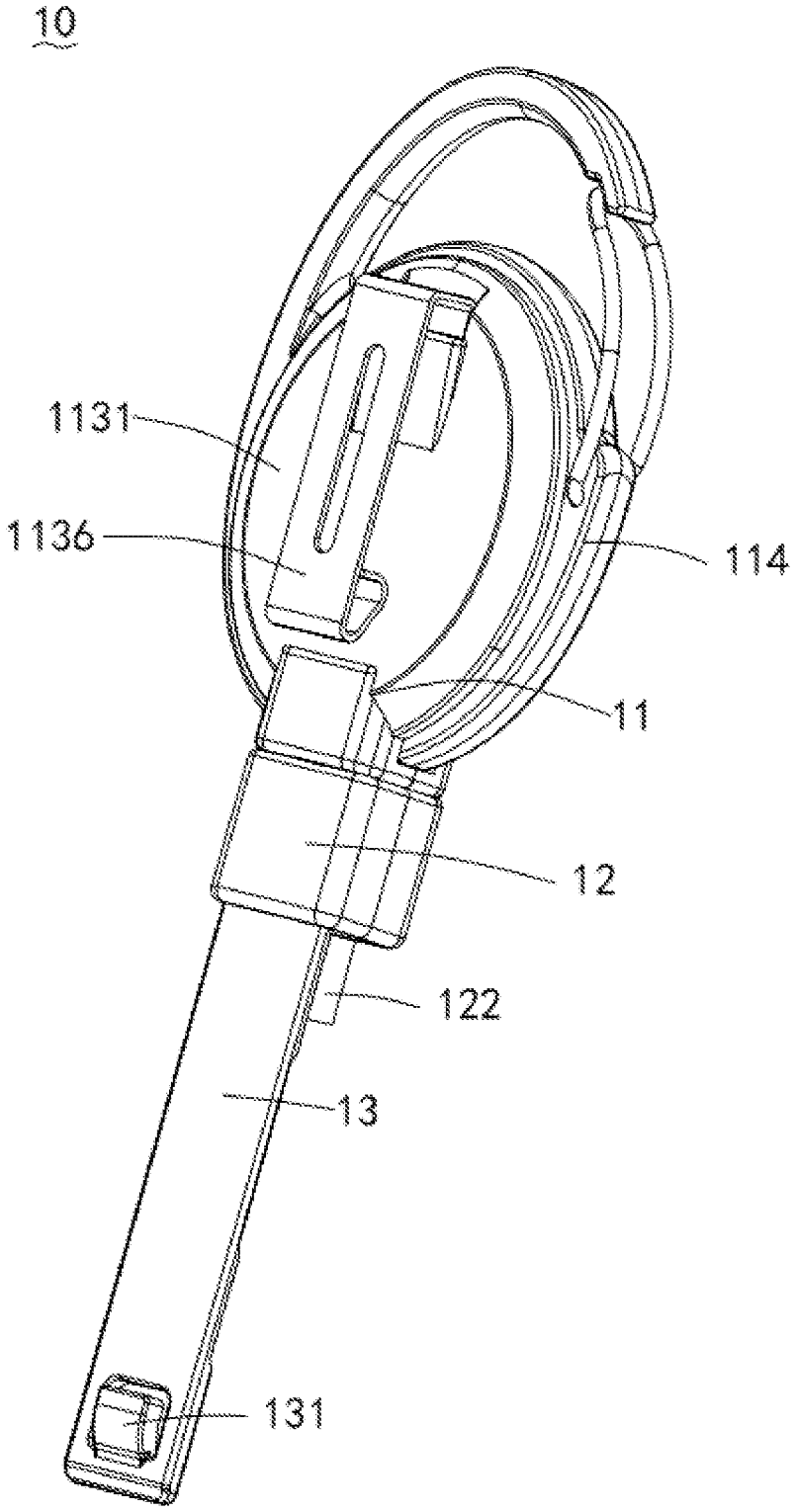
FIG. 4 is another schematic diagram of a buckle strap according to a first embodiment.
Figure 5:
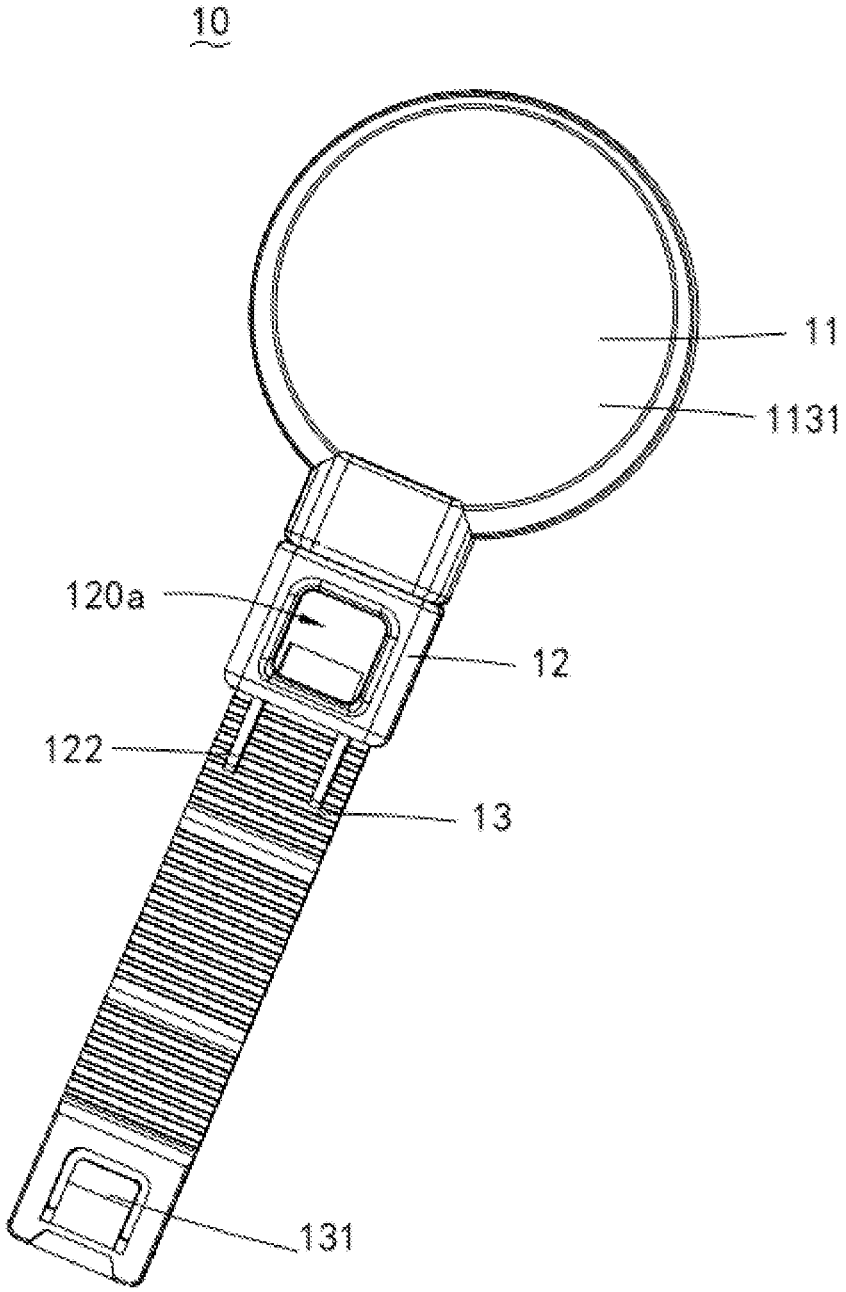
FIG. 5 is a schematic diagram of a buckle strap according to a second embodiment.
Figure 6:
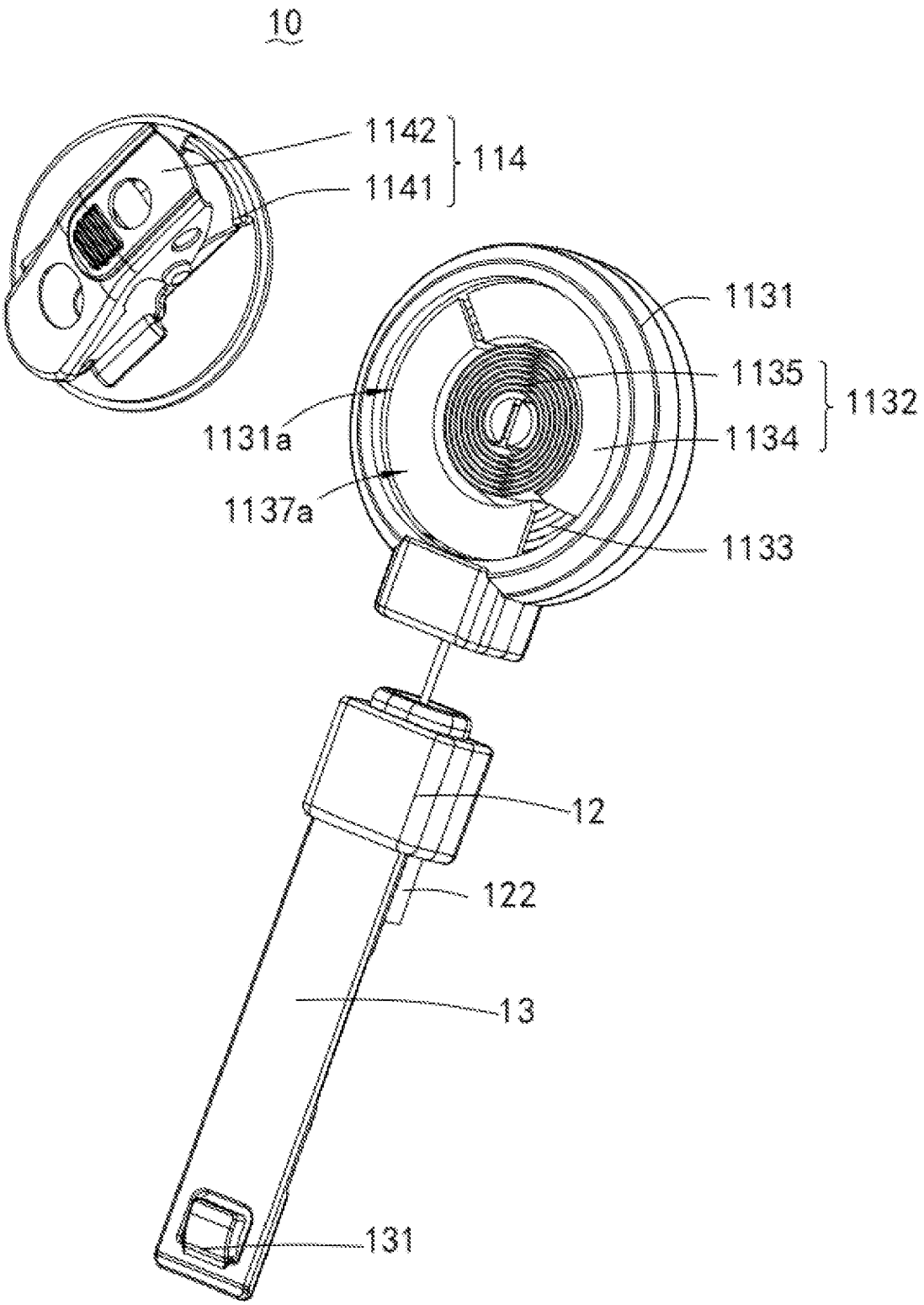
FIG. 6 is an exploded diagram of a buckle strap according to a second embodiment.

In some embodiments, the hanging member 11 may include a clasp structure 114. The clasp structure 114 includes a holding portion 1141 and a moving portion 1142 movably connected to the holding portion 1141. The holding portion 1141 is connected to the shell 1131. An end of the moving portion 1142 abuts against the holding portion 1141. The moving portion 1142 is configured to be pressed, so as to allow the moving portion 1142 and the holding portion 1141 to form a width-variable opening. Referring to FIG. 1, in a first embodiment, a cross-section of the holding portion 1141 has an approximate "6" shape, and a cross-section of the moving portion 1142 is an inferior arc. The holding portion 1141 is fixedly connected to the shell 1131. An end of the moving portion 1142 is rotatably connected to the holding portion 1141. When the moving portion 1142 is pressed, the moving portion 1142 and the holding portion 1141 form the width-variable opening, so as to attach the buckle strap 10 to an external object. When the moving portion 1142 is released, it automatically rebounds and then abuts against the holding portion 1141, so that the moving portion 1142 and the holding portion 1141 are closed, thereby preventing the buckle strap 10 from falling off the external object. In some embodiments, referring to FIG. 4, an elastic piece 1136 is disposed on a side of the shell 1131 facing away from the second hole wall 1212, which is configured to fasten the buckle strap 10 to an exterior object. Referring to FIG. 5 and FIG. 6, in a second embodiment, a rotation hole 1137*a* is defined in the shell 1131. The rotation hole 1137*a* is in communication with the accommodation cavity 1131*a*. The holding portion 1141 is accommodated in the rotation hole 137*a*, and is rotatable with respect to the shell 1131. An end of the moving portion 1142 abuts against the holding portion 1141, and the moving portion 1142 is configured to be pressed, so as to allow the moving portion 1142 and the holding portion 1141 to form a width-variable opening. In this embodiment, the moving portion 1142 and the holding portion 1141 function similarly to a clip 112. That is, when the moving portion 1142 is pressed, the moving portion 1142 and the holding portion 1141 form the width-variable opening, so as to clip the buckle strap 10 onto an external object. Such structure makes it easier to hang the buckle strap 10, with no need for any additional hook. For example, in a case that a hanging band 1111 is rope-shaped, and there is a need to hang the buckle strap 10, a hook needs to be additionally disposed, so as to hang the hanging band 1111 on the hook.

Figure 7:
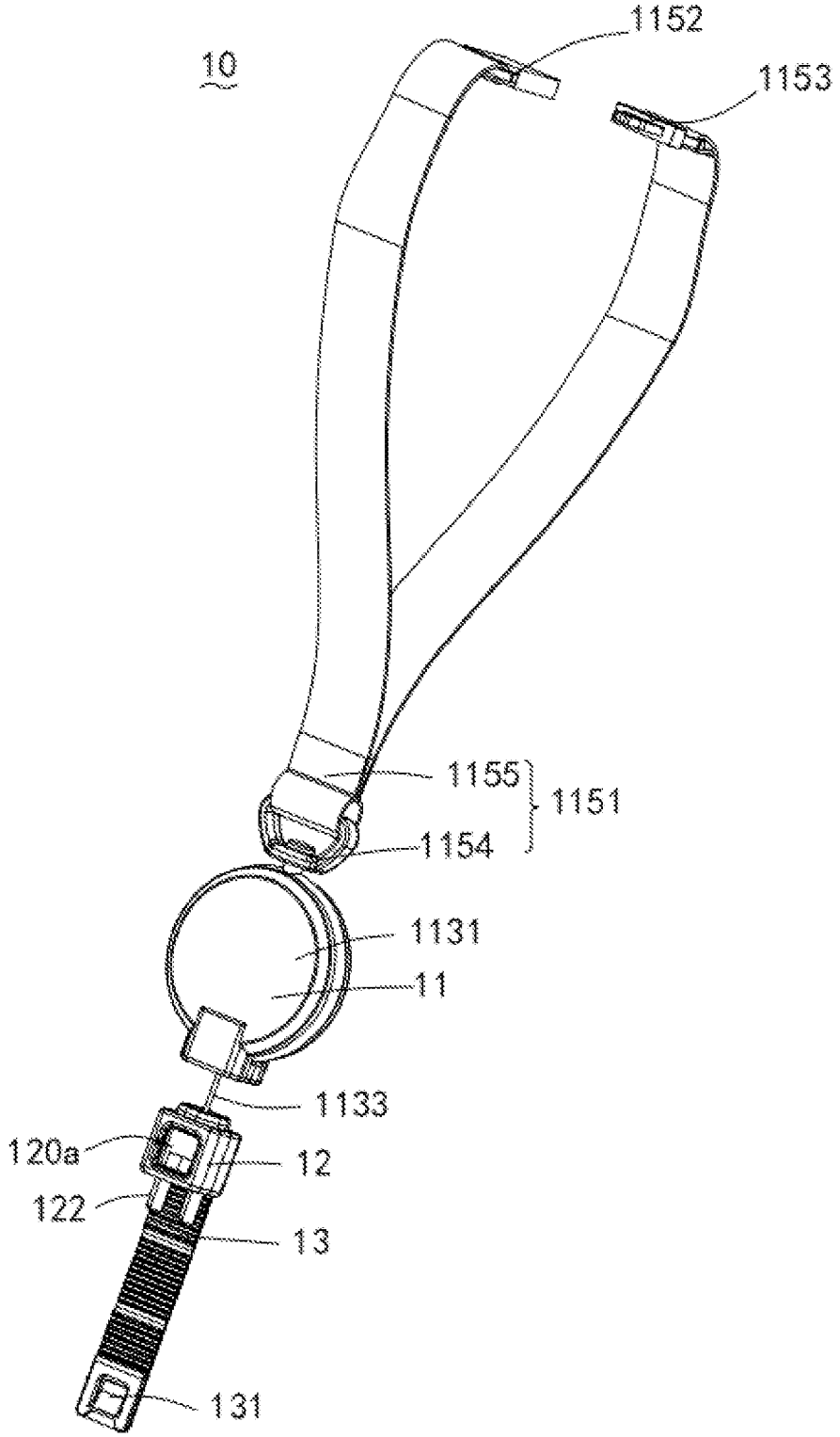
FIG. 7 is a schematic diagram of a buckle strap according to a third embodiment.

Referring to FIG. 7, in a third embodiment, the hanging member 11 may include a lanyard 1151, a first snap-fit portion 1152, and a second snap-fit portion 1153. The lanyard 1151 is disposed to pass through an end of the shell 1131 away from the base 12. The first snap-fit portion 1152 is connected to a first end of the lanyard 1151, and the second snap-fit portion 1153 is connected to a second end of the lanyard 1151. The first snap-fit portion 1152 is configured to be in detachable snap-fit connection with the second snap-fit portion 1153, so as to form a hanging hole with the lanyard 1151 for hanging the buckle strap 10 on an external object. Specifically, the lanyard 1151 includes a connection ring 1154 and a lanyard body 1155 connected to the connection ring 1154. The connection ring 1154 is rotatably connected to an end of the shell 1131 away from the flexible strap 13. A connection shaft is disposed on one of the shell 1131 and the connection ring 1154, and a shaft hole matching with the connecting shaft is defined in the other one of the shell 1131 and the connection ring 1154, so as to realize the rotatable connection between the connection ring 1154 and the shell 1131. In other embodiments, the connection ring 1154 may be rotatably connected to the shell 1131 by other rotatable connection means. Such structure is conducive to the rotation of the lanyard body 1155 in a horizontal plane, making the lanyard 1151 more flexible.

Figure 8:
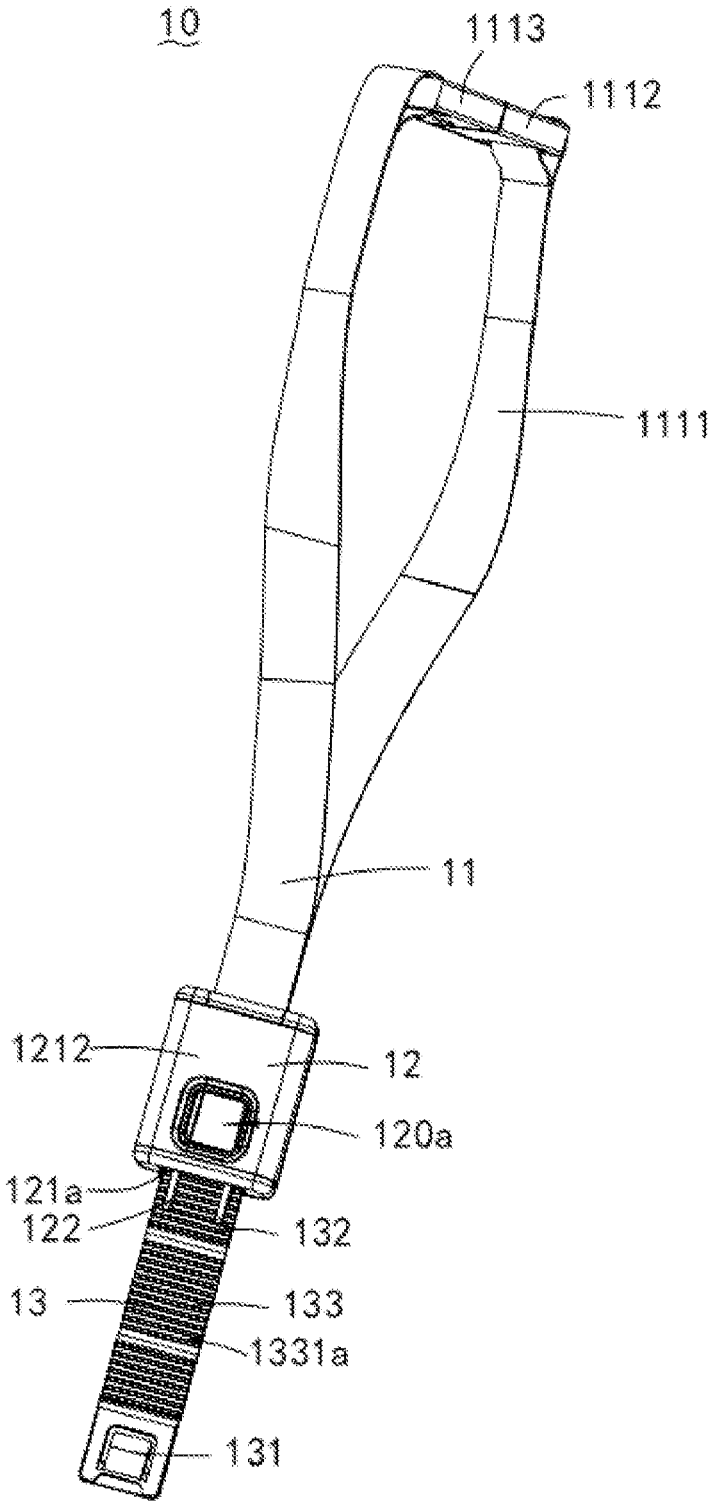
FIG. 8 is a schematic diagram of a buckle strap according to a fourth embodiment.
Figure 9:
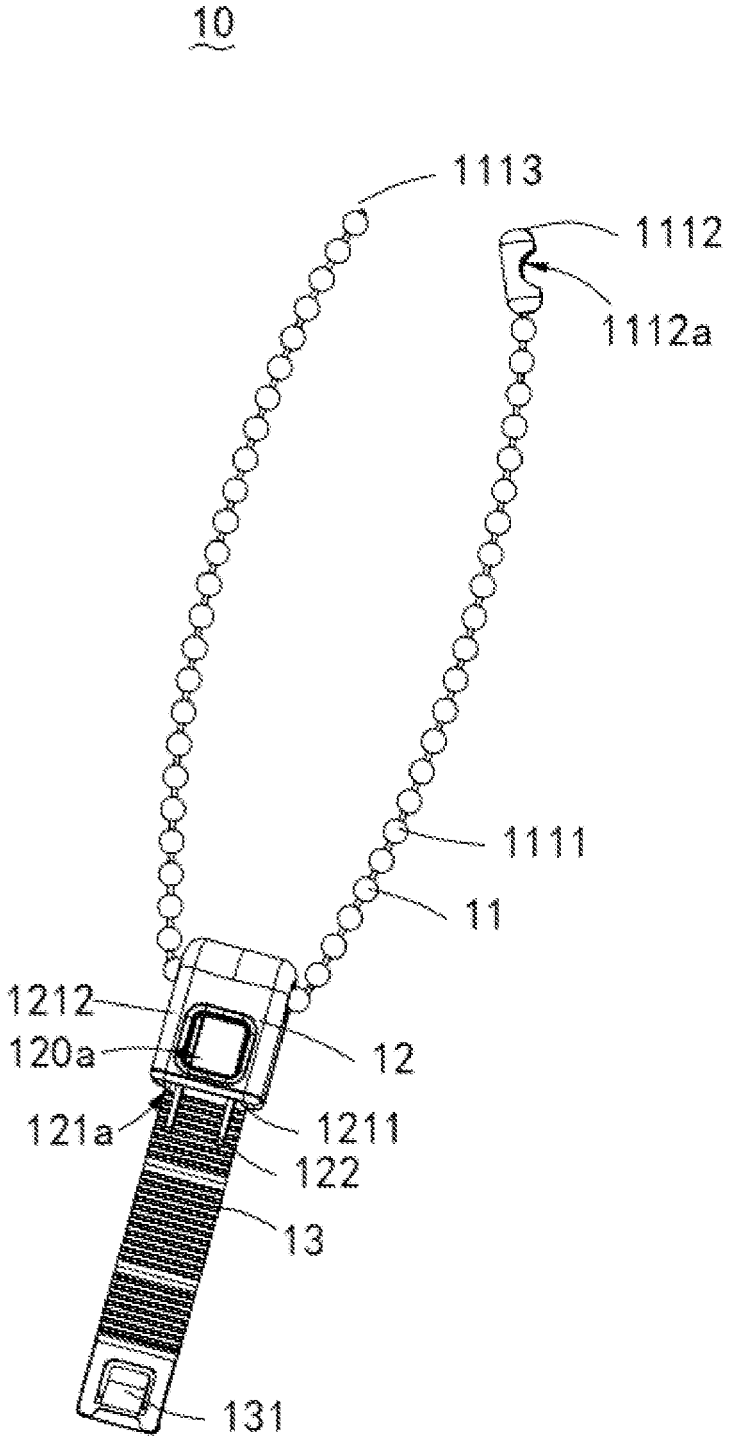
FIG. 9 is a schematic diagram of a buckle strap according to a fifth embodiment.
Figure 10:
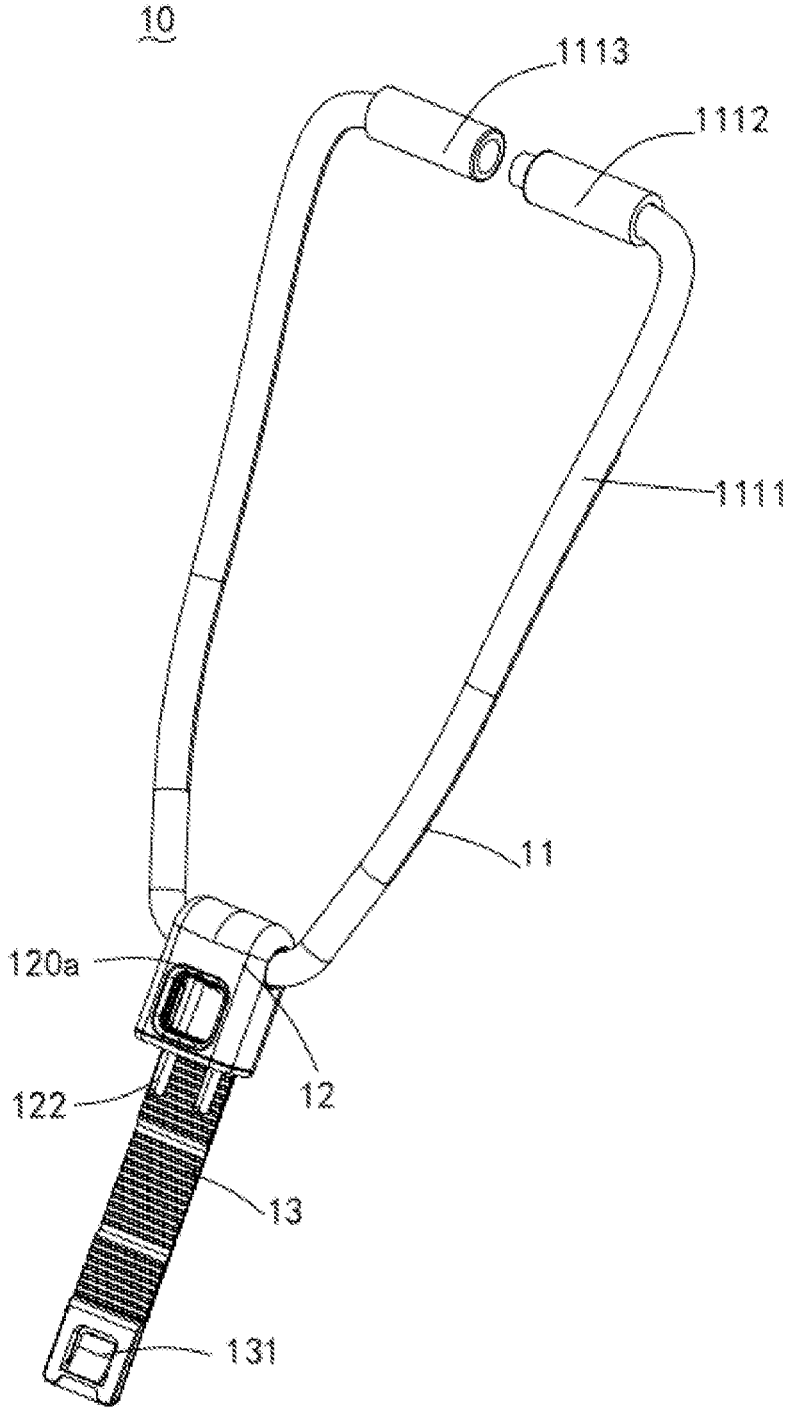
FIG. 10 is a schematic diagram of a buckle strap according to a sixth embodiment.

In some embodiments, the hanging member 11 may include a hanging band 1111, a first fastener 1112, and a second fastener 1113. The first fastener 1112 is connected to a first end of the hanging band 1111, and the second fastener 1113 is connected to a second end of the hanging band 1111. The second fastener 1113 is configured to be in detachable engagement with the second fastener 1113, so as to form a hanging hole with the hanging band 1111. Referring to FIG. 8, in a fourth embodiment, the hanging band 1111 may be a wide-edge strap. The hanging band 1111 is disposed to pass through an end of the base 12 away from the flexible strap 13. The first fastener 1112 and the second fastener 1113 may have rectangular cross-sections, and the two may be in detachable engagement with each other. Referring to FIG. 9, in a fifth embodiment, the hanging band 1111 includes a plurality of spherical bodies connected. The hanging band 1111 is disposed to pass through an end of the base 12 away from the flexible strap 13. The first fastener 1112 is an approximately hollow cylinder, and a notch 1112*a* is defined in a surface of the cylinder. The notch 1112*a* is configured to allow the second fastener 1113 to pass through, so that the first fastener 1112 is in detachable engagement with the second fastener 1113. Referring to FIG. 10, in a sixth embodiment, the hanging band 1111 may have a round cross-section. The hanging band 1111 is disposed to pass through an end of the base 12 away from the flexible strap 13. The first fastener 1112 and the second fastener 1113 each may have a round cross-section. A convex column is disposed on the first fastener 1112, so as to be in detachable engagement with the second fastener 1113.

Figure 11:
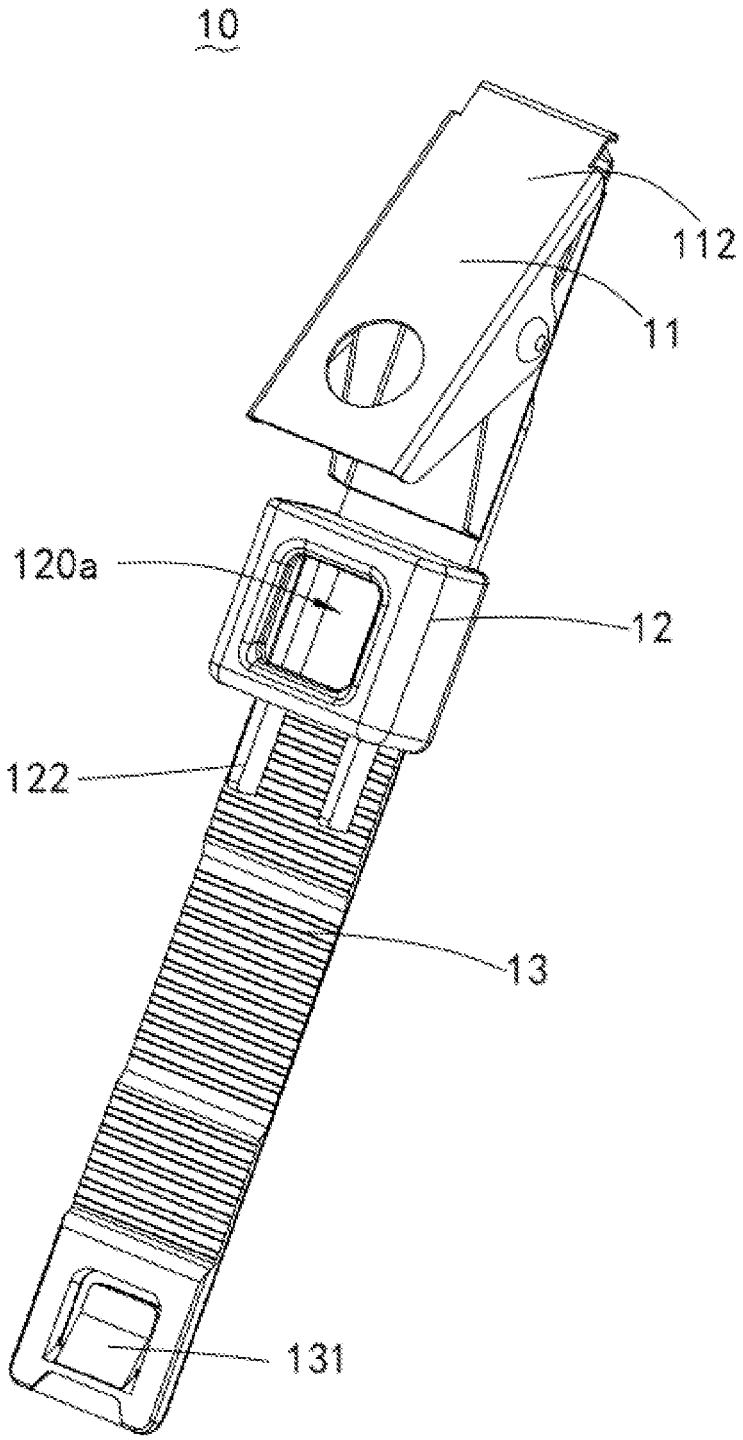
FIG. 11 is a schematic diagram of a buckle strap according to a seventh embodiment.

Referring to FIG. 11, in a seventh embodiment, the hanging member 11 may include a clip 112. The clip 112 is fixedly connected to an end of the base 12 away from the flexible strap 13. The clip 12 is configured to be pressed, so as to form a width-variable opening. That is, when the clip 112 is pressed, it forms the width-variable opening, so as to clip the buckle strap 10 onto an external object. Such structure makes it easier to hang the buckle strap 10 with no need for any additional hook. For example, in a case that the hanging band 1111 is rope-shaped, and there is a need to hang the buckle strap 10, a hook needs to be additionally disposed, so as to hang the hanging band 1111 on the hook.

The technical features of the foregoing embodiments may be combined in any manner. For simplicity of description, all possible combinations of the technical features in the foregoing embodiments are not described. However, as long as there is no contradiction in the combinations of these technical features, these combinations should be considered within the scope of the present disclosure.

The foregoing embodiments are merely a part of embodiments of the present disclosure. These embodiments are described in detail, but cannot be understood as a limitation on the scope of the present disclosure. It should be noted that, modifications and improvements made by those skilled in the art without departing from the concept of the present disclosure all fall within the scope of protection of the present disclosure. Therefore, the scope of protection of the present disclosure shall be subject to the appended claims.

What is claimed is:

1. A buckle strap, comprising:

a hanging member;

a base, the base being connected to the hanging member, and a fixing hole being defined in the base; and a flexible strap, a first end of the flexible strap being fixedly connected to the base, a fixing block being disposed at a second end of the flexible strap, the flexible strap being configured to be bendable and deformable, to allow the fixing block to be close to and stuck in the fixing hole, so as to form a loop for attaching a hanging item, and the fixing block being further configured to be pressed, so as to detach from the fixing hole;

a mounting hole is defined in the base;

the mounting hole is in communication with the fixing hole;

the mounting hole has a first hole wall and a second hole wall opposite to each other;

an end of the flexible strap away from the fixing block is connected to the first hole wall;

the fixing hole is circumferentially closed, and is defined in the second hole wall; and the fixing block protrudes out of a side of the flexible strap facing away from the second hole wall, in a case that the flexible strap is straightened.

2. The buckle strap according to claim 1, wherein the flexible strap comprises:

two connection portions spaced apart; and a bending portion connected between the two connection portions;

wherein a thickness of the two connection portions is greater than a thickness of the bending portion;

a first one of the two connection portions is connected to the first hole wall, and a second one of the two connection portions is connected to the fixing block;

more than two grooves spaced apart are defined in the bending portion and the two connection portions respectively; and the more than two grooves are distributed on a side of the connection portions and the bending portion facing away from the fixing block, in a case that the flexible strap is straightened.

3. The buckle strap according to claim 2, wherein the buckle strap further comprises:

two support bars;

wherein the two support bars are connected to the first hole wall and protrude out of the mounting hole, and the two support bars are disposed at intervals from the second hole wall; and the two support bars are located between the two connection portions, in a case that the fixing block is stuck in the fixing hole.

4. The buckle strap according to claim 2, wherein the hanging member comprises:

a hanging band;

a first fastener; and a second fastener;

wherein the first fastener is connected to a first end of the hanging band, and the second fastener is connected to a second end of the hanging band; and the second fastener is configured to be in detachable engagement with the second fastener, so as to form a hanging hole with the hanging band.

5. The buckle strap according to claim 2, wherein the hanging member comprises:

a clip;

wherein the clip is configured to be pressed, so as to form a width-variable opening.

6. The buckle strap according to claim 1, wherein the hanging member comprises:

a shell;

a reset assembly; and a pull cord;

wherein an accommodation cavity is defined in the shell;

the reset assembly is accommodated in the accommodation cavity;

a first end of the pull cord is fixedly connected to the reset assembly, and a second end of the pull cord is fixedly connected to the base;

the base is configured to pull the pull cord out of the accommodation cavity; and the reset assembly is configured to drive the pull cord been pulled out of the accommodation cavity to retract into the shell and wind around the reset assembly.

7. The buckle strap according to claim 6, wherein the hanging member further comprises:

a clasp structure;

wherein the clasp structure comprises:

a holding portion; and a moving portion, the moving portion being movably connected to the holding portion;

wherein the holding portion is connected to the shell, an end of the moving portion abuts against the holding portion, and the moving portion is configured to be pressed, so as to allow the moving portion and the holding portion to form a width-variable opening.

8. The buckle strap according to claim 6, wherein the hanging member comprises:

a lanyard;

a first snap-fit portion; and a second snap-fit portion;

wherein the lanyard is disposed to pass through an end of the shell away from the base, the first snap-fit portion is connected to a first end of the lanyard, the second snap-fit portion is connected to a second of the lanyard, and the first snap-fit portion is configured to be in detachable snap-fit connection with the second snap-fit portion, so as to form a hanging hole with the lanyard.

9. The buckle strap according to claim 6, wherein the hanging member comprises:

a magnetic attraction component;

wherein the magnetic attraction component is disposed at an end of the shell close to the base, and is configured to be in magnetic attraction operation with the base.

10. A buckle strap, comprising:

a hanging member;

a base, the base being connected to the hanging member, and a fixing hole being defined in the base; and a flexible strap, a first end of the flexible strap being fixedly connected to the base, a fixing block being disposed at a second end of the flexible strap, the flexible strap being configured to be bendable and deformable, to allow the fixing block to be close to and stuck in the fixing hole, so as to form a loop for attaching a hanging item, and the fixing block being further configured to be pressed, so as to detach from the fixing hole;

wherein the hanging member comprises:

a shell;

a reset assembly; and a pull cord;

wherein an accommodation cavity is defined in the shell;

the reset assembly is accommodated in the accommodation cavity;

a first end of the pull cord is fixedly connected to the reset assembly, and a second end of the pull cord is fixedly connected to the base;

the base is configured to pull the pull cord out of the accommodation cavity; and the reset assembly is configured to drive the pull cord been pulled out of the accommodation cavity to retract into the shell and wind around the reset assembly.

* * * * *